US007614175B2

(12) United States Patent
Davis et al.

(10) Patent No.: US 7,614,175 B2
(45) Date of Patent: Nov. 10, 2009

(54) METHOD AND APPARATUS FOR RAPID MOUNTING AND DISMOUNTING OF A FIREARM ACCESSORY

(75) Inventors: Vetis Boyd Davis, Flower Mound, TX (US); Jose Ivan Rodriguez, Richardson, TX (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/824,507

(22) Filed: Jun. 29, 2007

(65) Prior Publication Data

US 2009/0000174 A1 Jan. 1, 2009

(51) Int. Cl.
*F41G 1/38* (2006.01)

(52) U.S. Cl. ..... 42/127; 42/124; 42/125; 42/126

(58) Field of Classification Search ..... 89/34; 42/111, 114, 117, 124, 125, 127, 146, 90, 42/126

See application file for complete search history.

(56) References Cited

U.S. PATENT DOCUMENTS

| | | | | |
|---|---|---|---|---|
| 4,216,600 | A * | 8/1980 | Brueckner et al. | 42/127 |
| 5,155,915 | A * | 10/1992 | Repa | 42/127 |
| 5,276,988 | A | 1/1994 | Swan | |
| 6,442,883 | B1 * | 9/2002 | Waterman et al. | 42/124 |
| 6,922,934 | B1 * | 8/2005 | Huan | 42/127 |
| 6,931,778 | B1 * | 8/2005 | Nelson et al. | 42/120 |
| 7,107,716 | B1 * | 9/2006 | Liao | 42/108 |
| 7,204,052 | B2 * | 4/2007 | Swan | 42/127 |
| 7,272,904 | B2 * | 9/2007 | Larue | 42/127 |
| 2005/0241212 | A1 | 11/2005 | Swan | |
| 2006/0123686 | A1 | 6/2006 | Larue | |
| 2006/0207156 | A1 | 9/2006 | Larue | |
| 2008/0092421 | A1 | 4/2008 | Beckmann | |
| 2008/0134559 | A1 | 6/2008 | Swan | |
| 2008/0155876 | A1 | 7/2008 | Matthews et al. | |

FOREIGN PATENT DOCUMENTS

DE 10 2004 008 A1 9/2005

OTHER PUBLICATIONS

PCT Search Report (Forms PCT/ISA/220 and 210) and PCT Written Opinion (Form PCT/ISA/237) mailed by the European Patent Office on Nov. 5, 2008 in PCT Application No. PCT/US2008/067666, 15 pages.

* cited by examiner

*Primary Examiner*—Stephen M Johnson
*Assistant Examiner*—Daniel J Troy
(74) *Attorney, Agent, or Firm*—Haynes and Boone, LLP

(57) ABSTRACT

A firearm accessory mount includes a main part with a rail receiving portion extending in a first direction that can receive a firearm mount rail, and includes a holding part with a rail engaging portion. The holding part is movable relative to the main part so that the rail engaging portion moves approximately parallel to a second direction forming an angle to the first direction. An adjusting portion positionally adjusts the rail engaging portion with respect to the main part, approximately parallel to a third direction transverse to each of the first and second directions. A manually operable member is operatively coupled to the holding part so that the holding part is moved approximately parallel to the second direction in response to movement of the member.

17 Claims, 6 Drawing Sheets

METHOD AND APPARATUS FOR RAPID MOUNTING AND DISMOUNTING OF A FIREARM ACCESSORY

FIELD OF THE INVENTION

This invention relates in general to accessories for firearms and, more particularly, to techniques for removably mounting a firearm accessory on a firearm.

BACKGROUND

In some situations, it is desirable to be able to mount an accessory on a firearm. The most common type of accessory is a sight or scope that can increase the accuracy with which a person can aim the firearm. The person views an intended target through the sight or scope in association with a reticle, often with a degree of magnification.

Accessories such as firearm sights are usually aftermarket devices that need to be mounted on the firearm after the manufacturer has made and shipped the firearm. Usually, it is the end user who selects and mounts the accessory on the firearm. In some circumstances, a person may want to be able to quickly switch from one accessory to another, for example from one sight to another sight. Therefore, it has become relatively standard for firearm manufacturers to provide an accessory mounting rail on the firearm. The rail is usually provided on the "receiver" of the firearm, or in other words the part of the firearm that carries the bolt.

One very common type of mounting rail is known in the industry as a Picatinny rail. Although the Picatinny rail is effectively an industry standard, the industry specification for the Picatinny rail is not particularly precise. For example, it includes a drawing that has some dimensional errors. As a result, Picatinny rails vary somewhat in dimension from manufacturer to manufacturer, and even among different versions of a Picatinny rail made by the same manufacturer.

Many firearm accessories such as sights and scopes are provided with mounting arrangements that are designed to cooperate with a Picatinny rail. While these existing mounting arrangements have been generally adequate for their intended purposes, they have not been satisfactory in all respects.

For example, some have one or more knobs that each need to be rotated through several 360° revolutions in order to couple or decouple the mounting arrangement to the rail. Devices of this type cannot be mounted to and dismounted from a rail as rapidly as is sometimes desirable.

A further consideration is that, due to the dimensional variations among different Picatinny rails, some mounting arrangements will tightly and securely grip some Picatinny rails, but cannot tightly and securely grip other Picatinny rails. In some cases, if a particular Picatinny rail happens to be on the large side, a user may have to press hard on a lever or other actuating member in order to get the clamping mechanism to properly lock onto the rail. The force exerted on the lever can sometimes cause the lever to break.

Still other mounting arrangements have a cam or other clamping part that, as it moves into a clamping position, rubs along the side of the Picatinny rail, thereby abrading the side of the rail. This can mar and/or burnish the rail, which in turn can reduce the ability of the rail to be tightly and securely gripped by the mounting arrangement.

BRIEF DESCRIPTION OF THE DRAWINGS

A better understanding of the present invention will be realized from the detailed description that follows, taken in conjunction with the accompanying drawings, in which.

DETAILED DESCRIPTION

Figure 1:
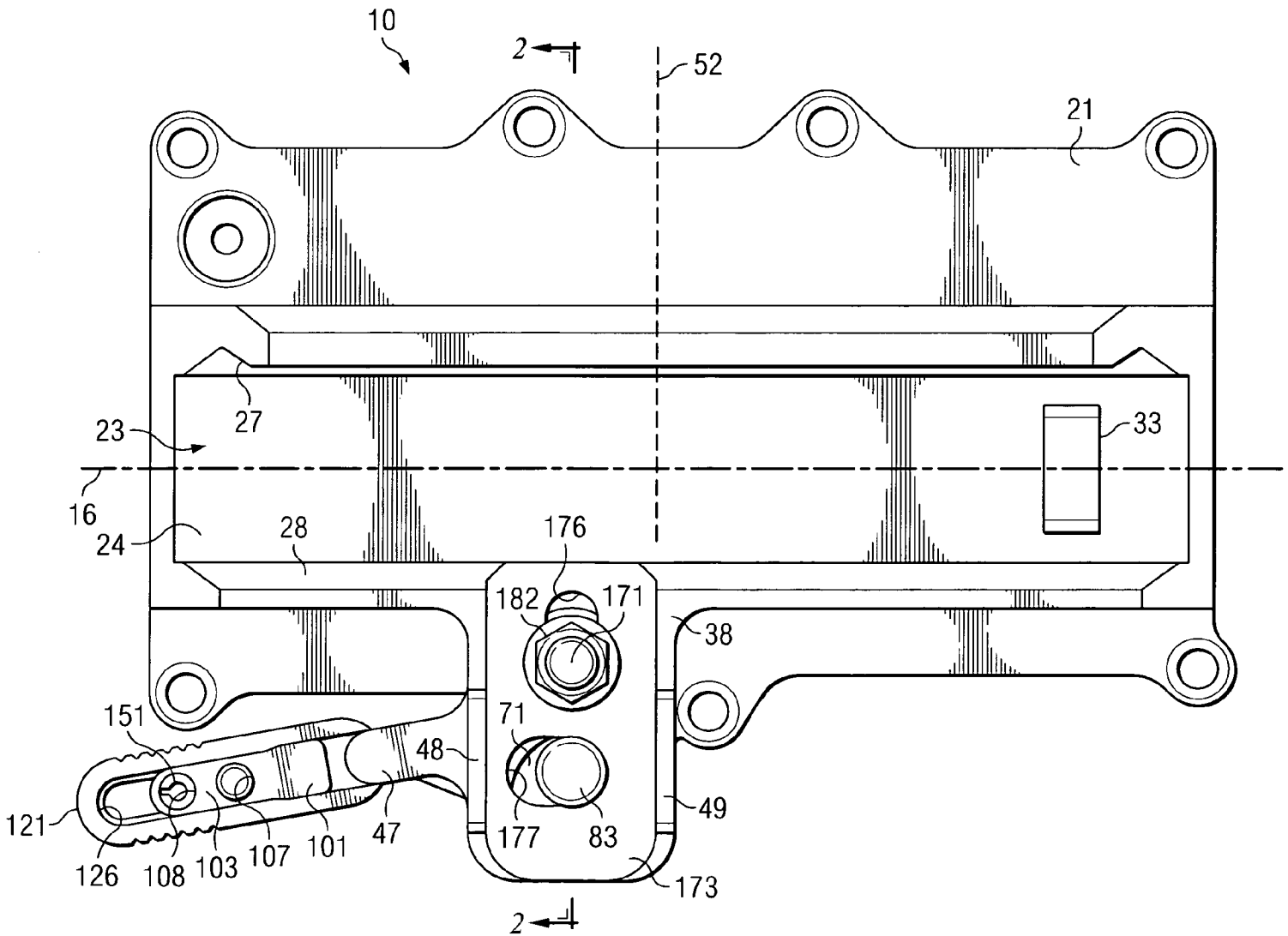
FIG. 1 is a diagrammatic bottom view of an apparatus that is a firearm accessory mount embodying aspects of the invention.
Figure 2:
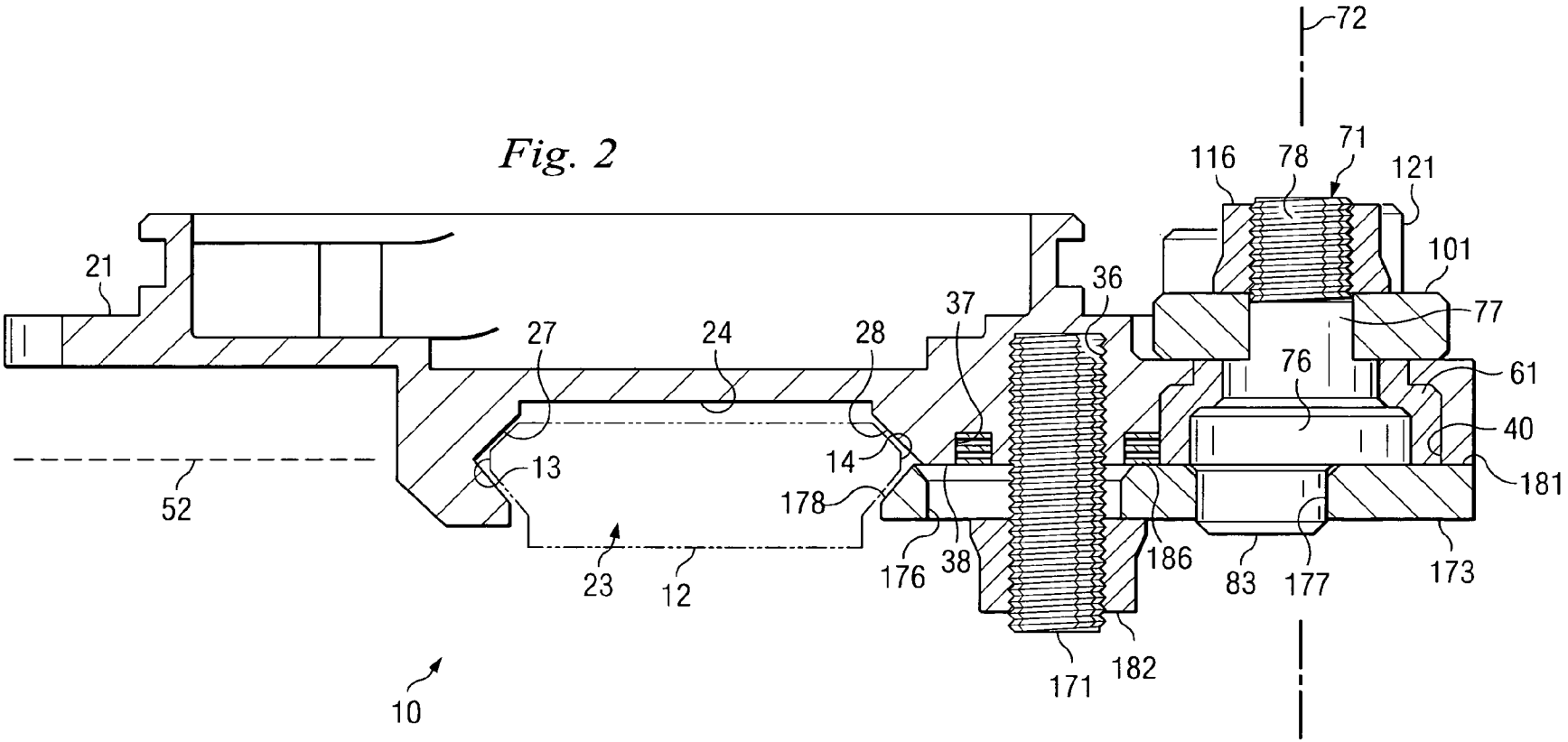
FIG. 2 is a diagrammatic sectional view taken along the section line 2-2 in FIG. 1.

FIG. 1 is a diagrammatic bottom view of an apparatus that is a firearm accessory mount 10 embodying aspects of the present invention. FIG. 2 is a diagrammatic sectional view taken along the section line 2-2 in FIG. 1. In the following discussion, words such as up, down, top, bottom, horizontal and vertical are used in relation to the normal operation orientation of the accessory mount 10, but it will be understood that this is for convenience and is not to be considered limiting. The accessory mount 10 is used to removably mount a not-illustrated accessory on the mounting rail 12 (FIG. 2) of a not-illustrated firearm, such as a rifle. The most common type of accessory is an aftermarket sight or scope, or in other words a device that is used to increase the accuracy with which the firearm can be aimed at a target. However, the accessory mount 10 can be used not only for a sight or scope, but also for any of a variety of other accessories.

The rail 12 in FIG. 2 is a conventional type of rail that is commonly known in the art as a "Picatinny" rail. Although the Picatinny rail is effectively an industry standard, the industry specification for the Picatinny rail is not particularly precise. For example, it includes a drawing that has some dimensional errors. As a result, Picatinny rails vary somewhat in dimension from manufacturer to manufacturer, and even among different versions of a Picatinny rail made by the same manufacturer. With reference to FIG. 2, the rail 12 is elongate in a horizontal direction perpendicular to the plane of FIG. 2. This direction is indicated diagrammatically in FIG. 1 by a broken line 16. The rail 12 has opposite side edges 13 and 14 that extend parallel to each other and to the direction 16. The side edges 13 and 14 each taper outwardly, and would end in a sharp corner or point, except that there is a chamfer or bevel surface extending along the outer end.

Figure 3:
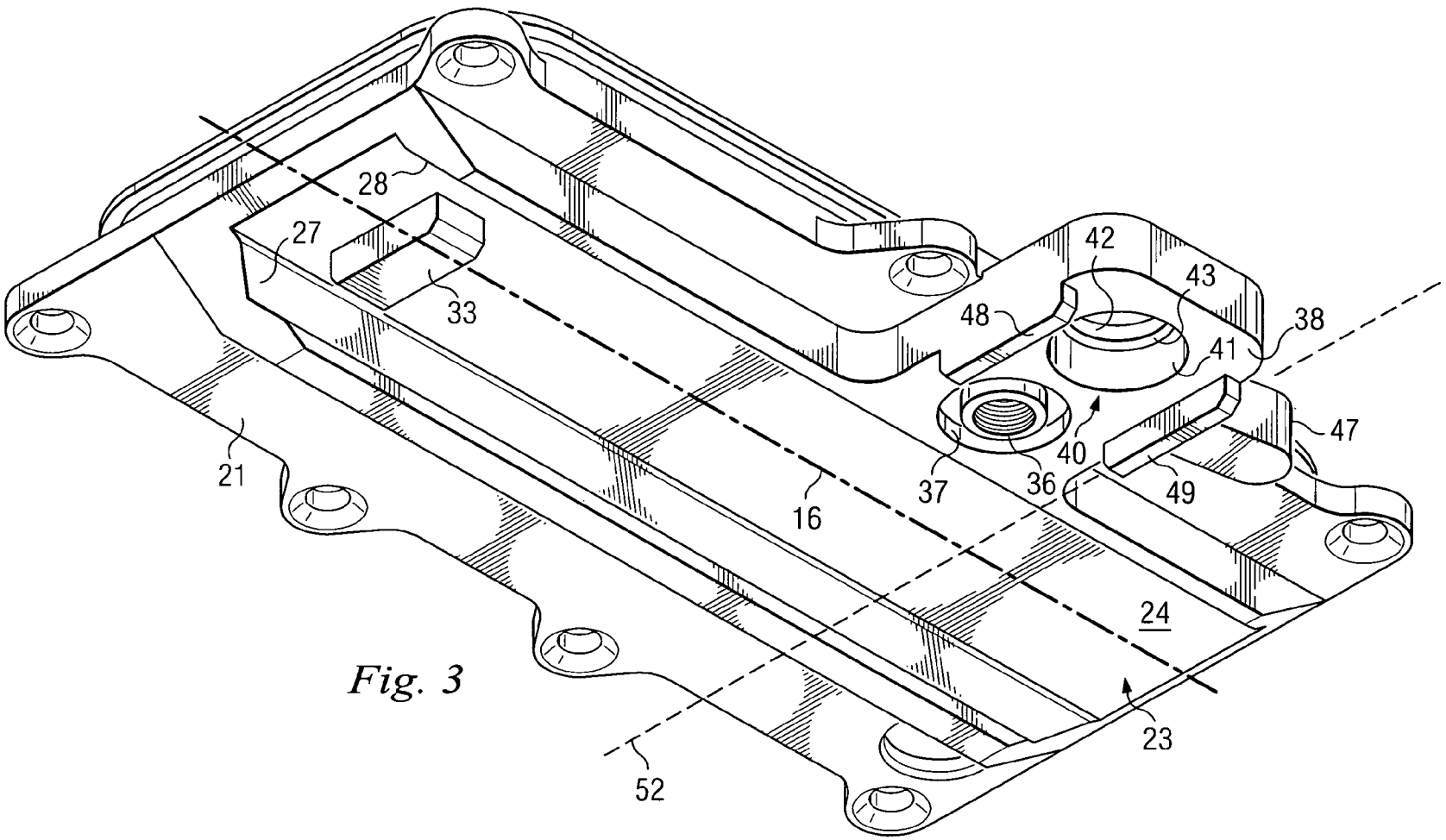
FIG. 3 is a diagrammatic perspective bottom view of a main part that is a component of the accessory mount of FIG. 1.

The accessory mount 10 has a main part or base 21. The base 21 is also sometimes referred to as a cover. FIG. 3 is a diagrammatic perspective bottom view of the main part 21. In the disclosed embodiment, the main part 21 is made of aluminum or an aluminum alloy, but it could alternatively be made of any other suitable material. A groove-like channel 23 is provided in the bottom of the main part 21. The channel 23 extends parallel to the direction 16, and is open at each end. The channel 23 has a flat inner surface 24, and two sides 27 and 28. The side 27 has two surfaces that intersect approximately at a right angle, to define a V-shaped groove. As shown in FIG. 2, this groove can slidably receive the outwardly tapered edge 13 of the rail 12. The other side of the channel 23 is defined by a surface 28 that is inclined at an angle of approximately 45° with respect to the inner surface 24, and that can slidably engage a surface on the edge 14 of the rail 12. Thus, the rail 12 can be received within the channel 23, and the accessory mount 10 is capable of sliding movement along the rail 12 in directions parallel to the line 16, until the accessory mount is securely clamped to the rail in a manner described later. With reference to FIGS. 1 and 3, a projection 33 is disposed within the channel 23, and extends downwardly from the inner surface 24. When the accessory mount 10 is securely clamped to the Picatinny rail 12, the projection 33 can engage any of several not-illustrated recesses provided at spaced locations along the length of the rail 12, in order to prevent sliding movement of the base 21 on the rail 12.

The base 21 has a downwardly-facing flat surface 38 that extends horizontally outwardly from the lower edge of the side 28 of the channel 23. A short distance outwardly from the side 28, the base 21 has a threaded cylindrical opening 36 that extends vertically upwardly from the surface 38. The opening 36 does not extend all the way through the base 21. The base 21 also has in the surface 38 a shallow annular groove 37 that concentrically encircles the opening 36, a short distance radially outwardly from the opening 36.

At a location spaced further outwardly from the channel 23, the base 21 has a further cylindrical opening 40 that extends vertically upwardly from the surface 38, and that opens through the top of the base. The opening 40 has a lower portion 41 and an upper portion 42. The lower portion 41 has a larger diameter than the upper portion 42, thereby defining a downwardly-facing annular shoulder 43 within the opening 40. The base 21 also has a tab 47 that projects horizontally outwardly from a location near the openings 36 and 40. Two spaced and parallel ribs or guides 48 and 49 are disposed on opposite sides of and project downwardly from the surface 38. The guides 48 and 49 each extend parallel to a horizontal direction 52 that is perpendicular to the horizontal direction 16.

Figure 4:
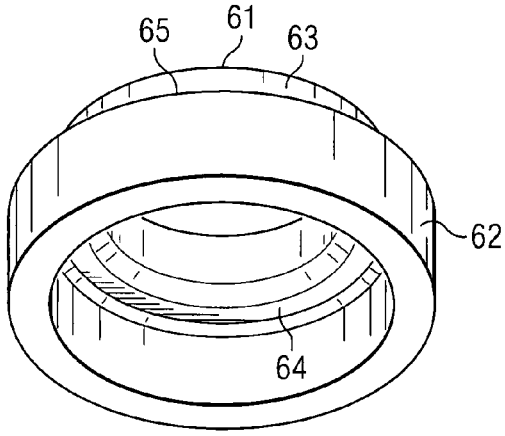
FIG. 4 is a diagrammatic perspective bottom view of a bushing that is a further component of the accessory mount of FIG. 1.

With reference to FIG. 2, the accessory mount 10 includes a sleevelike cylindrical bushing 61. FIG. 4 is a diagrammatic perspective bottom view of the bushing 61. The bushing 61 has a sleevelike lower portion 62 and a sleevelike upper portion 63. The lower portion 62 has inside and outside diameters that are respectively larger than the inside and outside diameters of the upper portion 63. Thus, the bushing 61 has a downwardly facing annular shoulder 64 in its interior, and upwardly facing annular shoulder 65 on its exterior. In the disclosed embodiment, the bushing 61 is made of steel, but it could alternatively be made of any other suitable material. The bushing 61 fits snugly with a force fit in the opening 40 (FIGS. 2 and 3) of the base 21.

Figure 5:
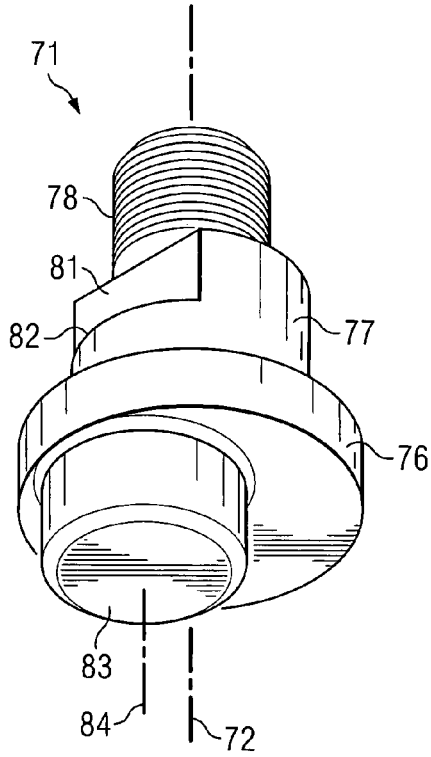
FIG. 5 is a diagrammatic perspective bottom view of a shaft that is yet another component of the accessory mount of FIG. 1.

With reference to FIG. 2, the accessory mount 10 includes a shaft 71 that can rotate about a vertical axis 72. FIG. 5 is a diagrammatic perspective bottom view of the shaft 71. The shaft 71 has a lower cylindrical portion 76, a middle cylindrical portion 77, and an upper cylindrical portion 78, all of which are concentric to the axis 72. The middle portion 77 has a larger diameter than the upper portion 78, and the lower portion 76 has a larger diameter than the middle portion 77. The upper portion 78 has external threads. The upper part of the middle portion 77 has flat surfaces on opposite sides thereof, one of which is visible at 81. Adjacent each flat surface is an upwardly facing shoulder, one of which is visible at 82. The shaft 71 has a cylindrical eccentric portion 83 that projects downwardly from a bottom surface of the lower portion 86. The eccentric portion 83 has an axis 84 that is parallel to but offset radially from the axis of rotation 72 of the shaft 71. In the disclosed embodiment, the shaft 71 is made of steel, but it could alternatively be made of any other suitable material.

With reference to FIGS. 2 and 5, the shaft 71 extends through and is rotationally supported by the bushing 61. The lower portion 76 of the shaft has a bottom surface that is approximately flush with a bottom surface of the bushing 61, and with the surface 38 on the base 21. The shoulders 82 on the shaft 71 are approximately flush with a top surface of the bushing 61, and with an adjacent surface on the base 21.

Figure 6:
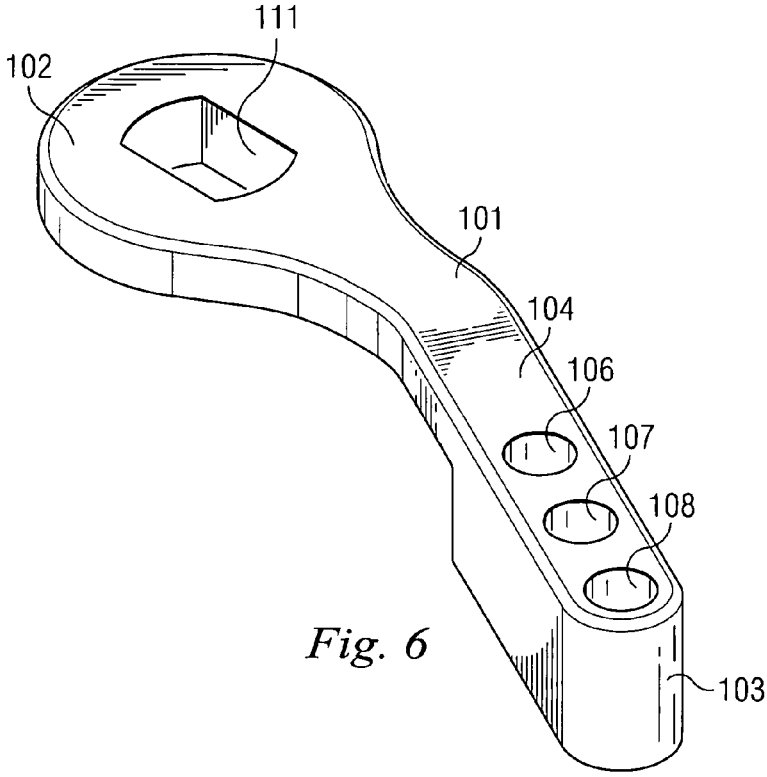
FIG. 6 is a diagrammatic perspective top view of a locking lever that is still another component of the accessory mount of FIG. 1.

With reference to FIGS. 1 and 2, the accessory mount 10 includes a locking lever 101. FIG. 6 is a diagrammatic perspective top view of the locking lever 101. In the disclosed embodiment, the locking lever 101 is made of steel, but it could alternatively be made of any other suitable material. The locking lever 101 has a disk-shaped portion 102 at one end, and an arm 103 extending outwardly from the disk-shaped portion 102. The locking lever 101 is generally plate-like, except that the outer end of arm 103 is thicker than the rest of lever 101. The lever 101 has a flat top surface 104. Near the outer end of the arm 103, three spaced cylindrical openings 106, 107 and 108 each extend downwardly from the top surface 104 into the thicker part of the arm 103. The openings 107 and 108 each extend completely through the arm 103. The opening 106 extends only partway through the arm 103. The disk-shaped portion 102 has in the center thereof a slot 111 that extends vertically through the portion 102.

With reference to FIGS. 2, 5 and 6, the slot 111 in the lever 101 receives the upper part of the middle portion 77 of the shaft 71. The flat surfaces 81 on opposite sides of the shaft 71 engage the flat surfaces on opposite sides of the slot 111, so that the lever 101 is fixed against rotation with respect to the shaft 71 about the axis 72. The disk-shaped end portion 102 of the lever 101 has a bottom surface that engages the upwardly-facing shoulders 82 on the shaft 71, and that slidably engages a top surface of the bearing 61. With reference to FIG. 2, a nut 116 engages the threaded upper portion 78 of the shaft 71, in order to keep the locking lever 101 in position on the shaft 71, and in order to keep the shaft 71 within the bushing 61.

Figure 7:
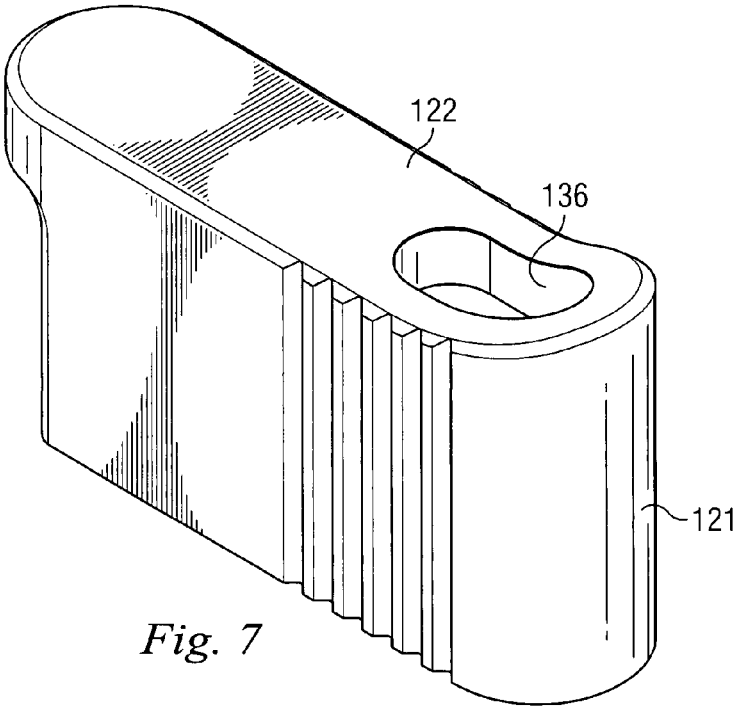
FIG. 7 is a diagrammatic perspective top view of a locking slide that is a further component of the accessory mount of FIG. 1.
Figure 8:
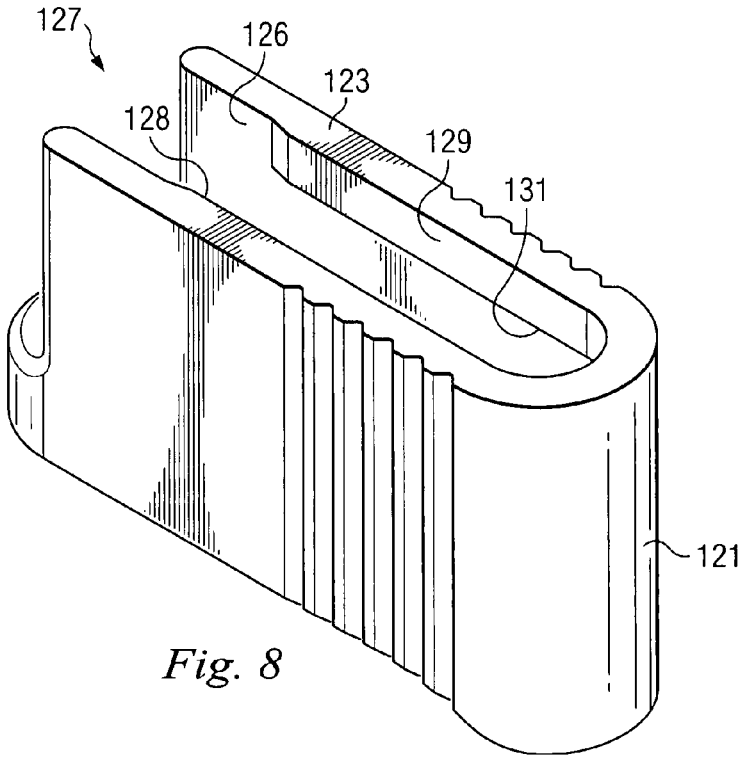
FIG. 8 is a diagrammatic perspective bottom view of the locking slide of FIG. 7.

With reference to FIG. 1, a locking slide 121 is movably supported on the outer end of the arm 103 of the lever 101. FIG. 7 is a diagrammatic perspective top view of the locking slide 121, and FIG. 8 is a diagrammatic perspective bottom view of the locking slide 121. In the disclosed embodiment, the locking slide 121 is made of aluminum or an aluminum alloy, but it could alternatively be made of any other suitable material. The locking slide 121 has a top surface 122, and a bottom surface 123. A recess 126 of approximately oval shape extends upwardly into the locking slide 121 from the bottom surface 123. At one end of the locking slide 121, the recess 126 opens laterally outwardly through a side wall of the slide, as indicated at 127. Horizontal ribs 128 and 129 are provided on opposite sides of the recess 126 adjacent the bottom surface 123, and each project inwardly a short distance. Each of the ribs 128 and 129 defines an upwardly facing shoulder, one of which is visible at 131. At the end of the slide 121 opposite from the open end 127 of the recess 126, a slot 136 extends vertically downwardly from the top surface 122 and opens into the recess 126.

Figure 9:
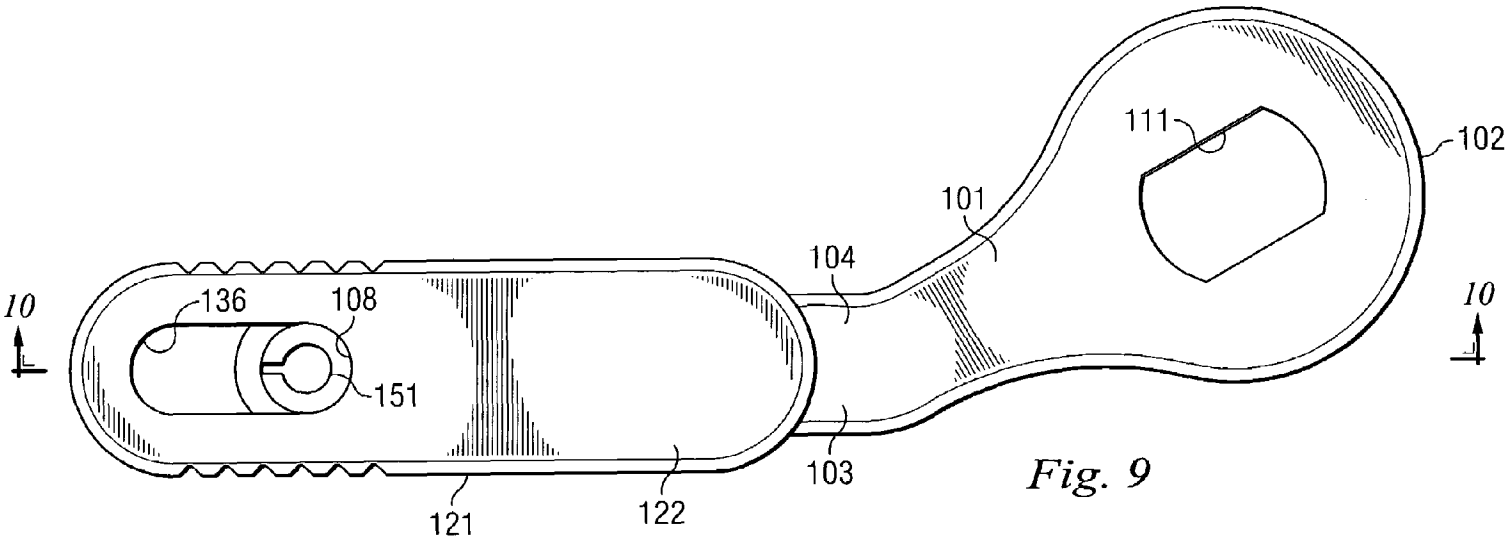
FIG. 9 is a diagrammatic top view showing the locking slide of FIGS. 7-8 slidably supported on the locking lever of FIG. 6.
Figure 10:
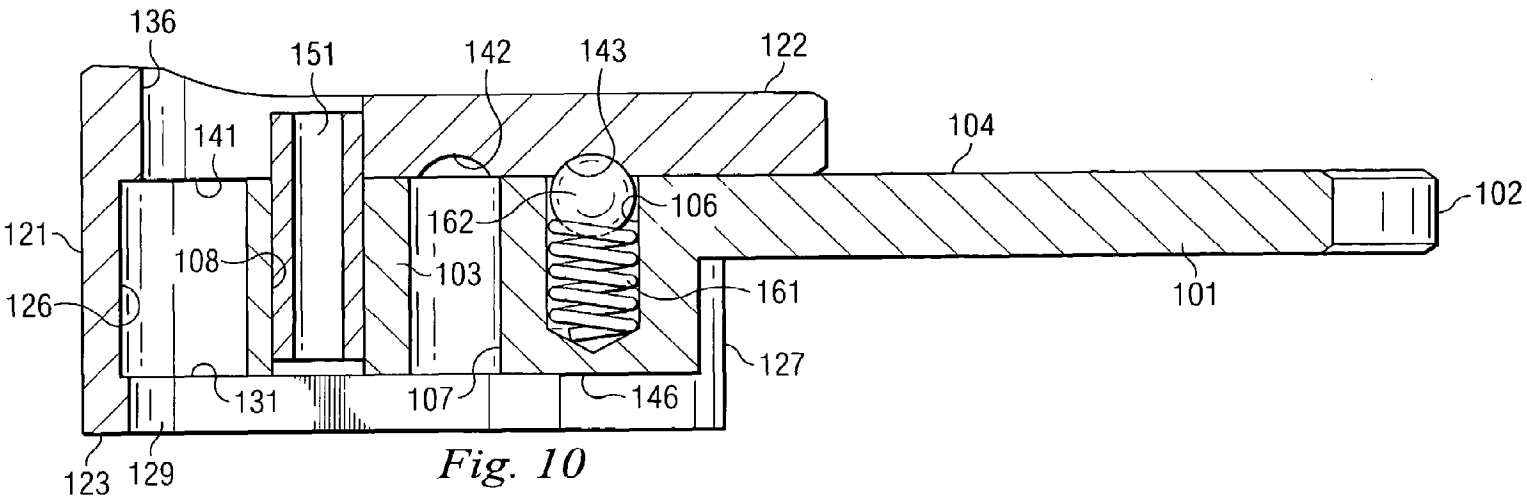
FIG. 10 is a diagrammatic sectional view taken along the section line 10-10 in FIG. 9.

FIG. 9 is a diagrammatic top view of the locking lever 101, with the slide 121 movably supported thereon. FIG. 10 is a diagrammatic sectional view taken along the section line 10-10 in FIG. 9. With reference to FIG. 10, an upper end of the recess 126 in the slide 121 is defined by a downwardly-facing top surface 141. The top surface 141 has two spaced, shallow recesses 142 and 143 that each have the shape of a portion of a sphere. The thick outer end of the arm 103 on lever 101 extends into the recess 126 through the open end 127, and is slidable within the recess 126. The upwardly facing top surface 104 of the lever 101 slidably engages the downwardly facing top surface 141 in the recess 126. A bottom surface 146 on the thick end of arm 103 slidably engages the upwardly facing shoulders 131 on each of the ribs 128 and 129. A tubular slotted spring pin 151 is made of steel, and is snugly received with a force fit in the vertical opening 108 of the lever arm 103. The upper end of the pin 151 extends beyond the top surface 104 of the lever, and is slidably received within the slot 136 in the slide 121. The upper end of the pin 151 can engage opposite ends of the slot 136 in order to limit sliding movement of the slide 121 relative to the lever arm 103.

A detent mechanism is disposed within the opening 106 in the lever arm 103, and includes a metal coil spring 161 disposed in the lower portion of the opening 106, and a steel ball bearing 162 disposed in the upper portion of the opening 106. The spring 161 resiliently urges the ball bearing 162 upwardly. The slide 121 can move with respect to the arm 103 between a locking position and a release position in which the ball bearing 162 respectively engages the recesses 142 and 143. As the slide 121 is moved from one position to the other, the ball bearing 162 is forced downwardly against the urging of the spring 161 as it leaves one recess, and then is moved back upwardly by the spring 161 when it reaches the other recess.

With reference to FIGS. 1 and 2, a threaded stud 171 has its upper end threadedly engaging the threaded opening 36 (FIGS. 2 and 3) in the base 21. This end of the stud 171 is fixedly secured within the opening 36 by a commercially-available adhesive, such as a cyanoacrylate adhesive. In the disclosed embodiment the stud 171 is made of steel, but it could alternatively be made of any other suitable material.

Referring to FIGS. 1 and 2, the accessory mount 10 also includes a platelike locking blade 173 that, in the bottom view of FIG. 1, has an approximately rectangular shape. In the disclosed embodiment the locking blade 173 is made of steel, but it could alternatively be made of any other suitable material. The locking blade 173 has two slots 176 and 177 that open vertically therethrough. The slot 176 extends approximately parallel to the direction 52, and the slot 177 extends approximately parallel to the direction 16. The locking blade 173 has an end surface 178 (FIG. 2) that is adjacent to the side 28 of the channel 23 in the base 21, and that is inclined at approximately 90° with respect to the surface defining the side 28 of the channel. The surfaces 28 and 178 together define a V-shaped groove that can slidably receive the outwardly tapered edge 14 of the rail 12.

The locking blade 173 has a top surface 181 that is slidably disposed against the downwardly facing surface 38 on the base 21. The groove 176 in the locking blade 173 slidably receives the threaded stud 171, and the groove 177 slidably receives the eccentric portion 83 of the shaft 71. The locking blade 173 is disposed between the guides 48 and 49 on the base 21, and each guide 48 and 49 slidably engages a respective side edge of the locking blade 173.

A locking nut 182 is threadedly engaged with the outer end of the threaded stud 171, and slidably engages the bottom surface of the locking blade 173. With reference to FIG. 2, a multiwave compression spring 186 is disposed within the annular groove 37, and slidably engages the top surface 181 of the locking blade 173. In the disclosed embodiment, the multiwave compression spring is obtained commercially as part number MW0375-0150-04S from Associated Spring Raymond, Barnes® Group Inc., of Maumee, Ohio. However, it would alternately be possible to use some other type of spring arrangement.

The multiwave compression spring 186 resiliently urges the locking blade 173 downwardly away from the base 21. Downward movement of the locking blade 173 under the urging of the spring 186 is limited by sliding engagement of the locking blade 173 with the locking nut 182 on the stud 171. By rotating the locking nut 182, the vertical position of the nut 182 on the stud 171 can be varied, and this in turn determines the vertical position of the end of locking blade 173 having the inclined end surface 178. Thus, by turning the locking nut 182, the surface 178 can be adjusted vertically with respect to the adjacent surface on base 21 that defines side 28 of the channel 23.

A brief description of the operation of the accessory mount 10 will now be provided. With reference to FIGS. 1 and 2, the lever 101 can be manually pivoted about the vertical axis 72, thereby rotating the attached shaft 71 about the axis 72. In response to this rotational movement of the shaft 71, the eccentric portion 83 of the shaft, through cooperation with the slot 177 in locking blade 173, moves the locking blade 173 horizontally with respect to base 21, parallel to the direction 52. During this movement, the threaded stud 171 slides within the slot 176.

If the lever 101 is pivoted counterclockwise in FIG. 1 from the illustrated position through an angle less than 180°, the locking blade 173 is moved horizontally outwardly, or in other words downwardly in FIG. 1 and rightwardly in FIG. 2. This moves the end surface 178 on the locking blade away from the channel 23 in the base 21, so that the rail 12 can be inserted into or removed from the channel. Assume that the rail 12 is inserted into the channel 23. The lever 101 is then pivoted clockwise in FIG. 1 back to the position illustrated in FIG. 1. As this occurs, the locking blade 173 is moved inwardly, or in other words upwardly in FIG. 1 and leftwardly in FIG. 2. This causes the end surface 178 on the locking blade to move to the position shown in FIGS. 1 and 2, where the rail 12 is retained within the channel 23. The geometry of the mechanism is such that, as the lever 101 is pivoted clockwise, the manual force needed to move the lever decreases, even as the rail is being gripped more tightly. Also, the eccentric portion 83 moves through an over-center position in relation to the Locking blade 173, such that the lever 101, the shaft 71 and the locking blade 173 all tend to remain in their locking positions.

With reference to FIG. 1, when the lever 101 is in this locking position, the slide 121 is aligned with the tab 47 on the base 21, and the slide 121 can be manually moved inwardly to its locking position, causing the tab 47 to be captured within the recess 126 in the slide. In this position of the slide 121, the cooperation of the slide 121 with the tab 47 holds the arm 101 against pivotal movement. Of course, as discussed above, the eccentric portion 83 is in an over-center position in relation to the locking blade 173, and thus the lever 101 would tend to remain in its locking position even without engagement of the slide 121 with the tab 47. However, engagement of the slide 121 with tab 47 avoids inadvertent movement of the lever 101 away from its locking position, for example where the firearm is being carried and the lever 101 is accidentally bumped against a stationary object such as a door frame. Eventually, the slide 121 can be manually moved outwardly to the position shown in FIG. 1, thereby releasing the tab 47 from the slide, so that the lever 101 can again be manually pivoted.

With reference to FIG. 2, the spring 186 urges the locking blade 173 downwardly against the locking nut 182. The locking nut 182 can be turned to adjust its vertical position on the stud 171, thereby adjusting the vertical position of the end surface 178 of locking blade 173 with respect to the surface defining side 28 of channel 23 in base 21. This permits the accessory mount 10 to be adjusted to readily accommodate dimensional variations from one Picatinny rail 12 to another. In particular, it ensures that the accessory mount 10 can be easily adjusted to securely grip any Picatinny rail 12, without being too loose or too tight. By avoiding a situation where the grip is too tight, there is no risk that a manual force needed to move the lever 101 to its locking position would be so great that it might bend or even break the lever 101. Since the locking blade 173 moves transversely with respect to the rail 12, the end surface 178 thereon does not rub against and abrade the locking rail 12 as the locking blade moves to and from its locking position. Since the lever 101 pivots through an angle less than 360°, and in fact less than 180°, the disclosed locking mechanism is a quick-release arrangement that permits the accessory mount 10 to be rapidly mounted on or dismounted from the rail 12.

Although a selected embodiment has been illustrated and described in detail, it should be understood that a variety of substitutions and alterations are possible without departing from the spirit and scope of the present invention, as defined by the claims that follow.

What is claimed is:

1. An apparatus comprising a firearm accessory mount that includes:

a main part having a rail receiving portion extending parallel to a first direction and configured to receive a firearm mount rail;

a holding part having a rail engaging portion;

first structure supporting said holding part for movement relative to said main part so that said rail engaging portion moves approximately parallel to a second direction extending at an angle with respect to said first direction, said structure including an adjusting portion for positionally adjusting said rail engaging portion with respect to said main part approximately parallel to a third direction transverse to each of said first and second directions;

a manually operable member supported for movement relative to said main part; and second structure operatively coupling said member and said holding part so that said holding part is moved approximately parallel to said second direction in response to movement of said member.

2. An apparatus according to claim 1, wherein said movement of said member with respect to said main part is pivotal movement through a range less than 360° about an axis extending approximately normal to said second direction.

3. An apparatus according to claim 2, wherein said range of pivotal movement of said member is less than 180°.

4. An apparatus according to claim 2, wherein said rail engaging portion on said holding part includes a rail engaging surface that extends approximately parallel to said first direction and that is oriented at an angle with respect to each of said second and third directions.

5. An apparatus according to claim 2, wherein said holding part has an opening therein; and wherein said second structure includes a shaft supported on said main part for rotation about said axis, said member being non-rotatably coupled to said shaft, and said shaft having a portion that is eccentric to said axis and received in said opening in said holding part.

6. An apparatus according to claim 5, wherein as said member rotates through said range of movement, said eccentric member moves through an over-center position in relation to said holding part.

7. An apparatus according to claim 2, including a locking portion supported stationarily with respect to said main part; and including a manually operable locking part supported on said member for movement between locking and release positions, wherein when said member is in a predetermined pivotal position and said locking part is in said locking position, said locking part engages said locking portion in a manner resisting pivotal movement of said member, said locking part being free of engagement with said locking portion when said locking part is in said release position.

8. An apparatus according to claim 7, wherein said movement of said locking part is movement approximately radially of said axis.

9. An apparatus according to claim 7, including structure that yieldably resists movement of said locking part away from either of said locking and release positions toward the other thereof.

10. An apparatus according to claim 9, wherein said structure that yieldably resists movement of said locking part includes a detent mechanism.

11. An apparatus according to claim 1, wherein said holding part has a slot that opens therethrough approximately in said third direction, and that extends approximately in said second direction;

wherein said first structure includes a stud that has one end fixed to said main part, that extends through said slot approximately parallel to said third direction, and that has threads on an end portion remote from said one end;

wherein said first structure includes a nut that engages said threads on said stud; and wherein said first structure includes resilient structure yieldably urging said holding part away from said main part approximately in said third direction.

12. An apparatus according to claim 11, wherein said resilient structure includes an annular spring extending around said stud between said main part and said holding part.

13. An apparatus according to claim 12, wherein said main part has an annular groove extending around said stud on a side of said main part that faces said holding part, said spring being at least partly disposed within said annular groove.

14. A method of coupling a firearm accessory mount to a firearm mount rail, the firearm accessory mount including a main part having a rail receiving portion extending parallel to a first direction and configured to receive the firearm mount rail, and including a holding part having a rail engaging portion, said method including:

supporting said holding part for movement relative to said main part so that said rail engaging portion moves approximately parallel to a second direction extending at an angle with respect to said first direction, and moves approximately parallel to a third direction transverse to each of said first and second directions;

providing an adjusting portion for positionally adjusting said rail engaging portion approximately in said third direction with respect to said main part;

supporting a manually operable member for movement relative to said main part; and moving said holding part approximately parallel to said second direction with respect to said main part in response to movement of said member.

15. A method according to claim 14, wherein said supporting of said manually operable member includes supporting said manually operable member for pivotal movement with respect to said main part through a range less than 360° about an axis extending approximately normal to said second direction.

16. A method according to claim 15, including configuring said holding part so that said rail engaging portion thereon includes a rail engaging surface that extends approximately parallel to said first direction and that is oriented at an angle with respect to each of said second and third directions.

17. A method according to claim 14, wherein said supporting of said holding part includes:

yieldably urging said holding part to move approximately parallel to said third direction; and configuring said adjusting portion to prevent movement of said holding part in said third direction beyond a selectively adjustable position.

* * * * *